US008590328B2

(12) United States Patent
Bittner et al.

(10) Patent No.: US 8,590,328 B2
(45) Date of Patent: Nov. 26, 2013

(54) REFRIGERATION SYSTEM WITH MULTI-FUNCTION HEAT EXCHANGER

(75) Inventors: John D. Bittner, Bethlehem, GA (US); Philip A. Stephenson, Newborn, GA (US)

(73) Assignee: Hill Phoenix, Inc., Conyers, GA (US)

( * ) Notice: Subject to any disclaimer, the term of this patent is extended or adjusted under 35 U.S.C. 154(b) by 968 days.

(21) Appl. No.: 12/699,720

(22) Filed: Feb. 3, 2010

(65) Prior Publication Data

US 2011/0185757 A1 Aug. 4, 2011

(51) Int. Cl.
*F25B 41/04* (2006.01)
*F25D 17/02* (2006.01)

(52) U.S. Cl.
USPC ..... 62/225; 62/201

(58) Field of Classification Search
USPC ..... 62/175, 181, 183, 185, 201, 225
See application file for complete search history.

(56) References Cited

U.S. PATENT DOCUMENTS

| | | | | |
|---|---|---|---|---|
| 3,365,899 | A | 1/1968 | Cuny et al. | |
| 3,365,900 | A | 1/1968 | Clark et al. | |
| 4,437,322 | A | 3/1984 | Ertinger | |
| 4,495,777 | A * | 1/1985 | Babington | 62/185 |
| 5,333,677 | A | 8/1994 | Molivadas | |
| 5,916,252 | A * | 6/1999 | Yoshida et al. | 62/204 |
| 6,109,047 | A | 8/2000 | Cowans et al. | |
| 6,192,694 | B1 | 2/2001 | Hiro et al. | |
| 6,282,917 | B1 | 9/2001 | Mongan | |
| 6,866,092 | B1 | 3/2005 | Molivadas | |
| 7,469,540 | B1 | 12/2008 | Knapton et al. | |

* cited by examiner

*Primary Examiner* — Marc Norman
(74) *Attorney, Agent, or Firm* — Foley & Lardner LLP

(57) ABSTRACT

A refrigeration system with a multi-function heat exchanger has a first heat exchanger with an internal partition defining a condenser, a subcooler and an evaporator. An expansion device is located external of the heat exchanger and receives condensed refrigerant from the subcooler and provides expanded refrigerant to the evaporator. A compressor circulates the refrigerant through the condenser, the subcooler, and the evaporator. A secondary coolant circulates through the subcooler, the evaporator and the loads. A control system receives refrigerant temperature and pressure signals, and provides a control signal to the expansion device to maintain a temperature of the refrigerant within a predetermined range. A second heat exchanger cools a condensing fluid circulating through the condenser to condense the refrigerant.

17 Claims, 3 Drawing Sheets

REFRIGERATION SYSTEM WITH MULTI-FUNCTION HEAT EXCHANGER

FIELD

The present invention relates to a refrigeration system. The present invention relates more particularly to a refrigeration system with a multi-function heat exchanger that includes a condenser, evaporator and subcooler as a single unit, and that interfaces with an external refrigerant expansion device.

BACKGROUND

It is well known to provide heat exchangers for use in refrigeration system. However, such known heat exchangers typically do not serve the combined purpose of a condenser for condensing refrigerant gas discharged from a compressor, along with an evaporator or chiller for chilling a secondary coolant loop that provides cooling to refrigerated display cases, into a single device. In several instances where a condenser has been combined with an evaporator, the combined units typically include an internal refrigerant expansion device and resulted in a number of disadvantages for use in applications with refrigerated display cases. Accordingly, it would be desirable to provide a refrigeration system with a multi-function heat exchanger that combines in a single device the functions of a condenser that receives a cool liquid for condensing hot refrigerant gas discharged from a compressor, and a chiller that receives cold, expanded refrigerant to chill a secondary loop of coolant (e.g. glycol, etc.) that is distributed to loads such as refrigerated display cases to cool products therein, in a manner that overcomes the disadvantages of prior heat exchangers.

SUMMARY

The present invention relates to a refrigeration system with a multi-function heat exchanger for providing cooling to one or more loads within a facility. The system includes a heat exchanger shell having an internal partition separating the shell into a top portion defining a condenser, and a bottom portion defining a subcooler and an evaporator. A discharge gas inlet, a condensate outlet, a condensing fluid inlet and a condensing fluid outlet are disposed on the top portion. A liquid subcooler inlet, a subcooled liquid outlet, an evaporator gas inlet, a suction evaporator outlet, a secondary coolant inlet, and a secondary coolant outlet are disposed on the bottom portion. An expansion device is disposed external of the shell and in fluid communication with the subcooled liquid outlet and the evaporator gas inlet. A primary refrigeration loop has a compressor and circulates a refrigerant from the compressor through a refrigerant flow path including the discharge gas inlet, the condenser, the condensate outlet, the liquid subcooler inlet, the subcooler, the subcooled liquid outlet, the expansion device, the evaporator gas inlet, the evaporator, the suction evaporator outlet, and back to the compressor. A secondary coolant loop circulates a liquid coolant from the loads through a secondary cooling flow path including the secondary coolant inlet, the secondary coolant outlet, and back to the loads. A control system includes a control module that receives a first signal representative of refrigerant temperature proximate the suction evaporator outlet and a second signal representative of refrigerant pressure proximate the suction evaporator outlet, and provides a control signal to the expansion device to maintain a desired superheat temperature of the refrigerant proximate the suction evaporator outlet. A condenser cooling loop has an outdoor heat exchanger and circulates a condensing fluid from the outdoor heat exchanger through a condensing flow path including the condensing fluid inlet, the condenser, the condensing fluid outlet, and back to the outdoor heat exchanger.

DETAILED DESCRIPTION

Referring to the FIGURES, a refrigeration system with a multi-function heat exchanger is illustrated schematically according to an exemplary embodiment where a condenser, evaporator (or chiller) and subcooler are combined in a single unit so that one portion (shown for example as a top portion) serves as a condenser and another portion (shown as a bottom portion) serves as the subcooler and chiller. The top condenser receives a liquid (e.g. water) cooled from an air-cooled device and returns the liquid to the air-cooled device. The liquid condenses the hot refrigerant gas discharged from the compressor. The condensed refrigerant leaves the condenser and is directed into the bottom portion to be subcooled and is then directed to an external expansion device. The subcooled liquid refrigerant is expanded in the expansion device (e.g. throttle valve, etc.) and then directed back into the bottom portion where it chills a secondary loop of coolant that is then circulated to loads (e.g. refrigerated display cases, etc.) throughout a facility.

Figure 1:
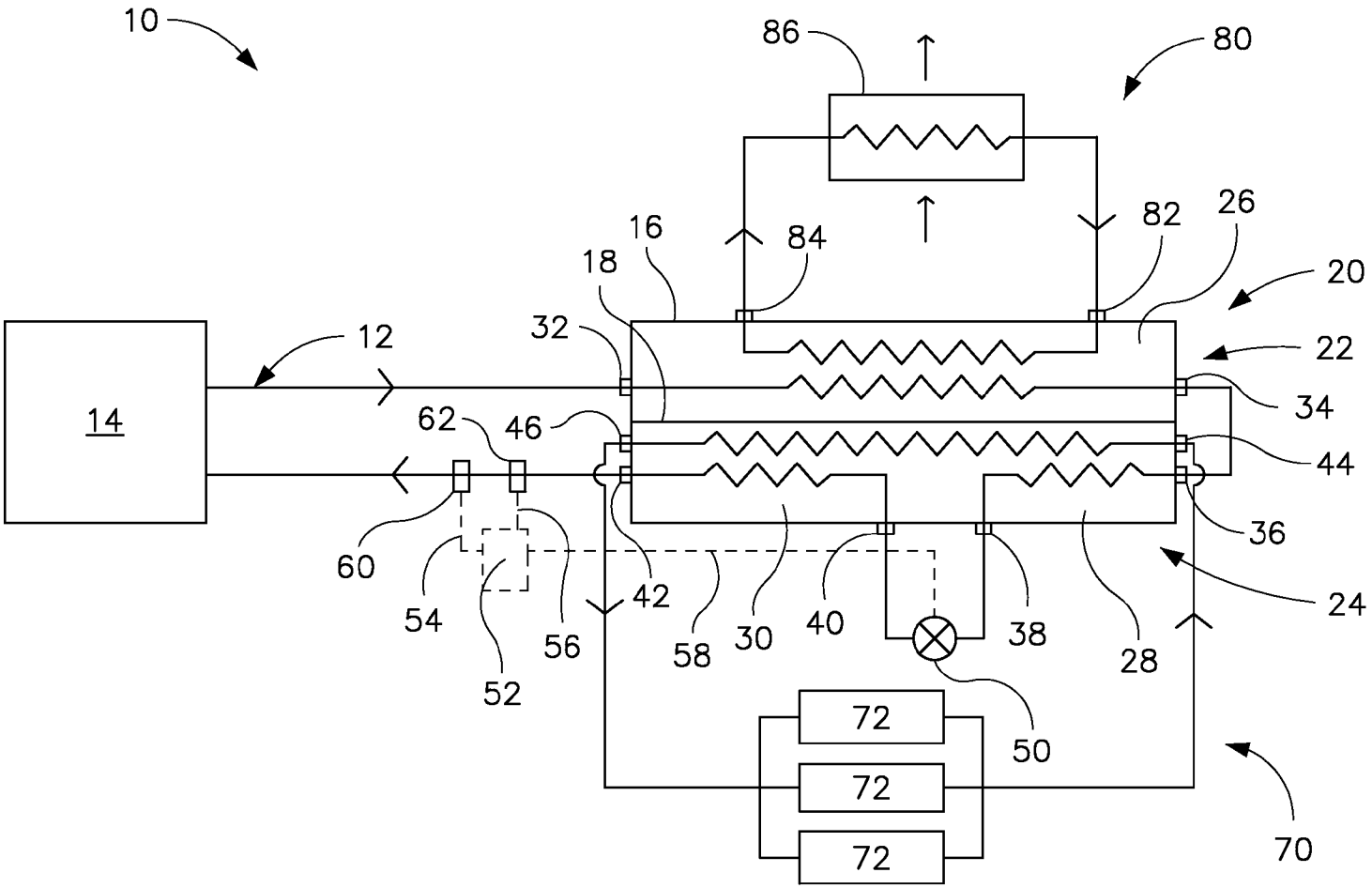
FIG. 1 is a schematic diagram of a refrigeration system with a multi-function heat exchanger, according to an exemplary embodiment.

Referring to FIG. 1, a refrigeration system 10 with a multi-function heat exchanger 20 is shown according to an exemplary embodiment. System 10 is shown to include a primary refrigeration loop 12 for circulating a refrigerant (e.g. R-404A, R-452, CO2, etc.) through a refrigerant flow path that includes one or more compressors 14. Compressed hot gas refrigerant is directed from the compressor 14 through a refrigerant flow path including a discharge gas inlet 32 on a top portion 22 of heat exchanger 20 which serves as a condenser 26. The condensed refrigerant is then directed through a condensate outlet 26 on the top portion 22 of the heat exchanger 20 and then through a liquid subcooler inlet 36 on a bottom portion 24 of the heat exchanger 20. A first part of the bottom portion 24 serves as a subcooler 28 to subcool the refrigerant. The subcooled refrigerant is then directed through a subcooled liquid outlet 38 to an externally-disposed expansion device 50 (e.g. thermostatic expansion valve, superheat valve, throttle valve, etc.), where the refrigerant is expanded to a low temperature saturated gas. The low temperature saturated gas is then directed through an evaporator gas inlet 40 on a second part of the bottom portion 24 of the heat exchanger 20, which serves as an evaporator 30 (or chiller) for chilling a secondary coolant in a secondary cooling loop 70 that is distributed to one or more loads 72 (e.g. refrigerated display cases, etc.) through out a facility (e.g. store, supermarket, etc.). The refrigerant is then discharged from the evaporator portion 30 of the heat exchanger 20 through a suction evaporator outlet 42 where the refrigerant is directed back to the compressor 14 to repeat the cycle.

According to the illustrated embodiment, the expansion device 50 is disposed external of the heat exchanger 20 and is controlled by a signal representative of a superheat temperature of the refrigerant at (or proximate to) the suction evaporator outlet 42 of the heat exchanger 20. For a medium-temperature refrigeration system, the saturation temperature of the refrigerant leaving the expansion device is typically within a range of approximately 17-32 degrees F., and more particularly within a range of 22-29 degrees F. and is intended to chill the loop 70 of secondary coolant in the evaporator portion 30. According to another exemplary embodiment for a low-temperature refrigeration system, the saturation temperature of the refrigerant is typically within a range of approximately minus (−)22 to minus (−)5 degrees F. However, the temperature ranges are described by way of example and any temperature range suitable for use in a refrigeration system for a desired application may be used. As the saturated liquid-vapor mixture of refrigerant progresses through the evaporator portion 30 and absorbs heat from the loop 70 of secondary coolant, the vapor percentage of the liquid-vapor mixture increases, and usually becomes completely vaporized. When the refrigerant is completely vaporized near the suction evaporator outlet 42 of the heat exchanger 20, the refrigerant temperature increases above the refrigerant's saturation temperature. The amount of temperature increase above the saturation temperature is referred to herein as the "superheat temperature." The expansion device 50 is configured to modulate a flow rate of the refrigerant corresponding to the duty or demand experienced by loop 70 of secondary coolant as it returns from the loads throughout the facility.

Referring further to FIG. 1, a control module 52 is provided to modulate the position of the expansion device 50 to provide a "critically charged" system in which a minimum amount of refrigerant is circulated to maintain the necessary amount of cooling for the loop 70 of secondary coolant in the evaporator portion 30. Control module 52 includes a suitable computing device (such as a microprocessor or programmable logic controller) configured to receive a signal representative of temperature 54 and a signal representative of pressure 56 of the vaporized refrigerant at or near the suction evaporator outlet 42, and to provide an output signal 58 used for controlling the position of the expansion device 50 to maintain the superheat temperature of the refrigerant within the bottom evaporator 30 portion within a desired range to provide sufficient cooling to the loop 70 of secondary coolant, but with a minimum amount of refrigerant.

Referring further to FIG. 1, a superheat temperature/pressure sensing arrangement is shown to include a temperature sensor 60 and a pressure sensor 62 provided at or near the suction evaporator outlet 42. The pressure sensor 62 provides a signal representative of refrigerant pressure to the control module 52, which calculates a corresponding saturation temperature (T sat) of the refrigerant at (or near) the exit of the heat exchanger 20. The temperature sensor 60 provides a signal representative of actual temperature of the refrigerant at or near the exit of the heat exchanger 20 (T exit). The control module 52 calculates the difference between T exit and T sat to determine the actual superheat temperature of the refrigerant. The control module 52 compares the actual superheat temperature of the refrigerant to a predetermined desired range or setpoint for the superheat temperature and sends an output signal 58 to modulate the position of the expansion device 50 to attain or maintain the desired superheat temperature at (or near) the exit of the evaporator portion 30 of the heat exchanger 20. According to a currently preferred embodiment, the temperature sensor 60 is a commercially available thermistor (but could be a thermocouple or RTD or the like) and the pressure sensor 62 is a commercially available pressure transducer.

Figure 2:
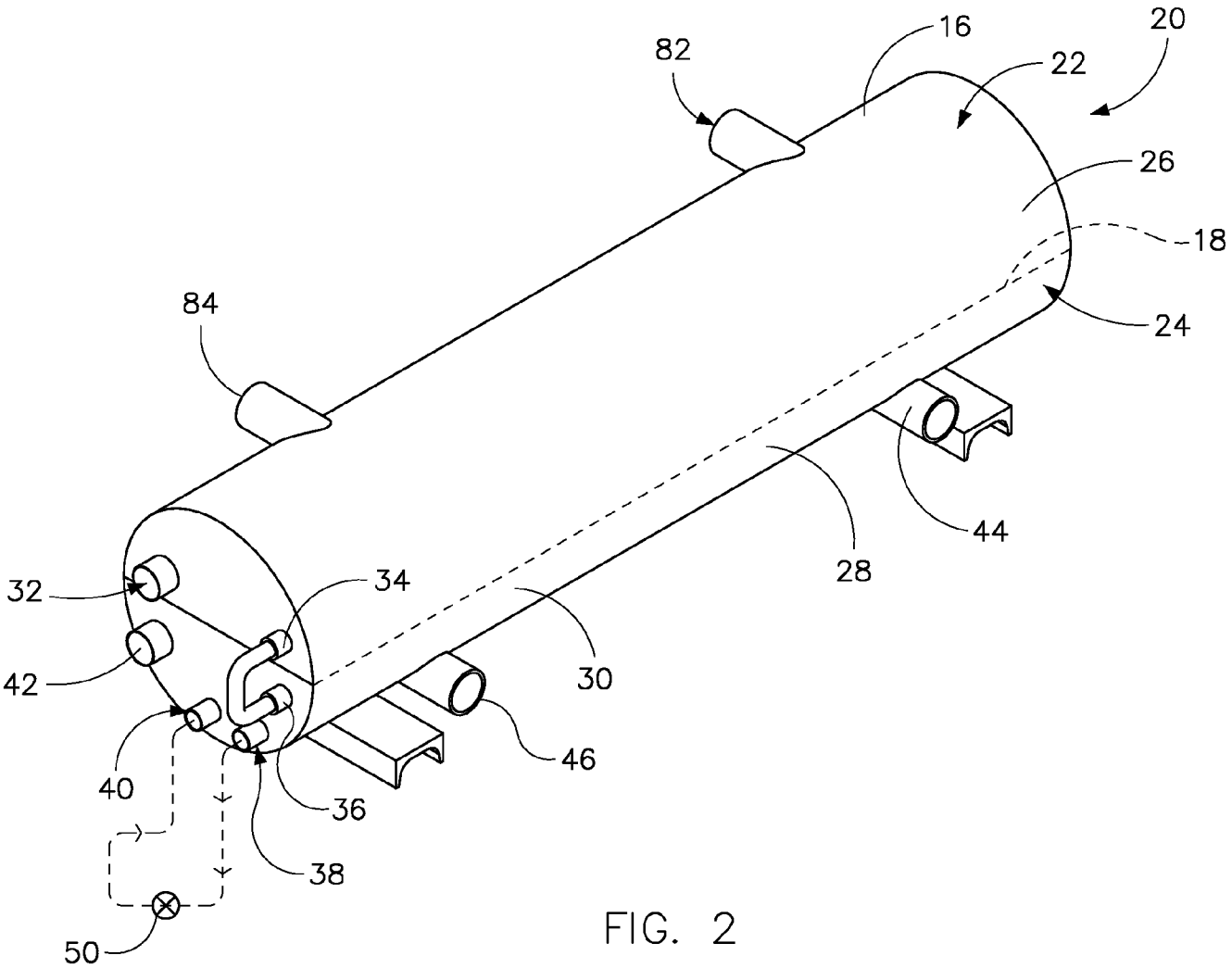
FIG. 2 is a schematic diagram of a multi-function heat exchanger for the refrigeration system of FIG. 1, according to an exemplary embodiment.

Referring to FIGS. 1 and 2, the refrigeration system 10 with a multi-function heat exchanger 20 is shown in further detail according to an exemplary embodiment. Heat exchanger is shown to include a shell 16 and a substantially flat and horizontal partition 18 that define a top portion 22 and a bottom portion 24. Top portion 22 serves as the condenser 26 for the system and receives the compressed hot refrigerant gas discharged from one or more compressors 14. The hot gas refrigerant is condensed in the condenser 26 by heat exchange with a condenser cooling loop 80 that circulates (e.g. by a pump or other suitable flow device—not shown) a condensing fluid (e.g. water etc.) through a condensing flow path that includes a condensing fluid inlet 82, the top condenser portion 26, a condensing fluid outlet 84, and an air cooled (typically outdoor) heat exchange device 86 (e.g. outdoor heat exchanger, such as a fan coil unit such as may be mounted on a rooftop or other outdoor location) for transferring heat to an outdoor ambient environment. The bottom portion 24 of the heat exchanger 20 serves as both a subcooler 28 for the condensed refrigerant, and as an evaporator 30 for chilling the loop 70 of secondary coolant (e.g. glycol, water, water-glycol mixture, CO2, etc.). The chilled secondary coolant is circulated (e.g. by a pump or other suitable flow device—not shown) through a secondary cooling flow path that includes a network of piping that circulates the secondary coolant through a secondary coolant inlet 44, the subcooler 28, the evaporator 30 (or chiller), a secondary coolant outlet 46, and one or more heat exchangers (e.g. gravity coils, fan coils, flow-through shelves, etc.) in a plurality of loads 72 (e.g. refrigerated display cases, etc.) within a facility to provide cooling and temperature control to products stored and displayed throughout the facility.

Figure 3:
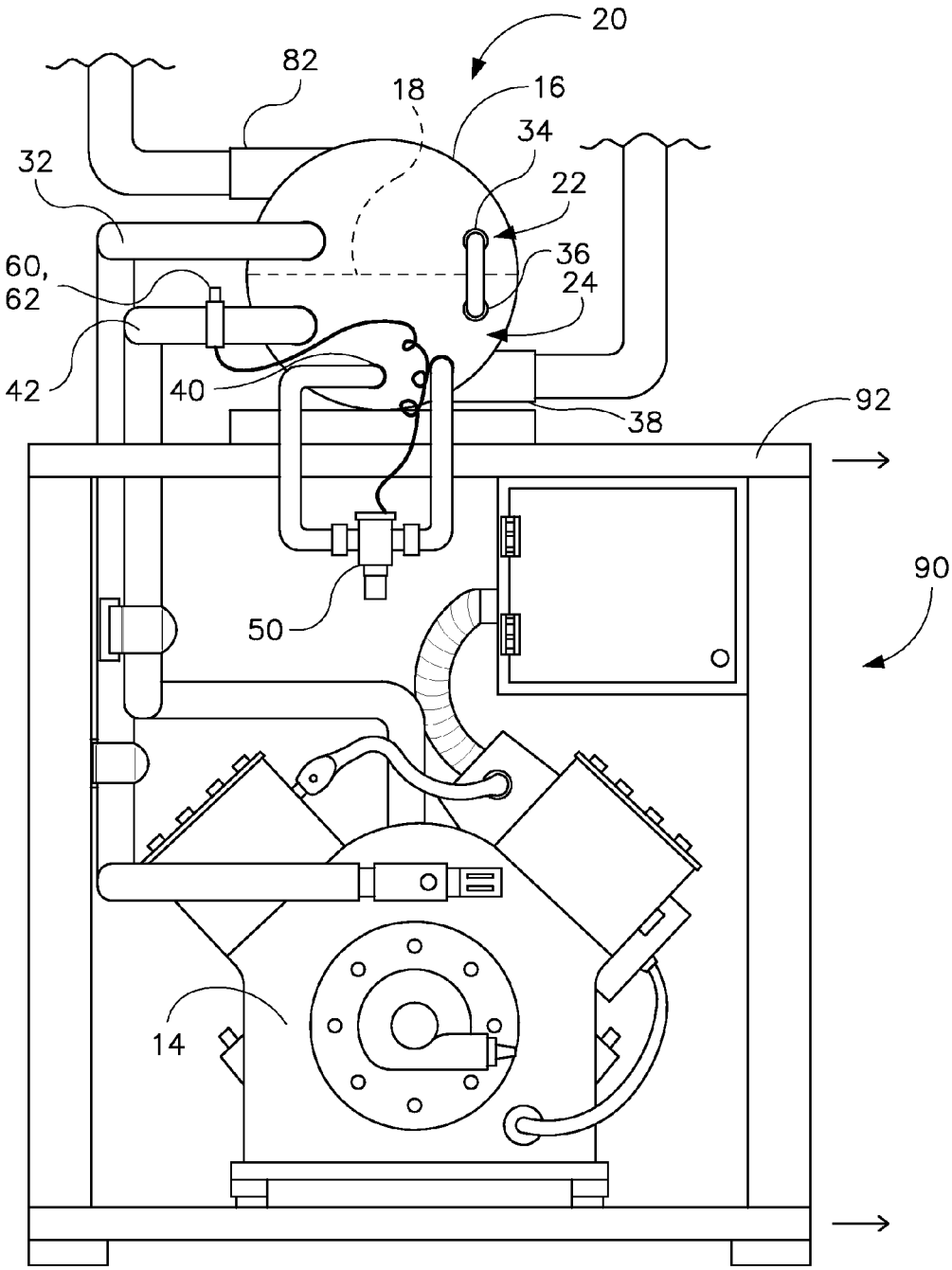
FIG. 3 is a schematic diagram of a rack configuration for the multi-function heat exchanger in the refrigeration system of FIG. 1, according to an exemplary embodiment.

Referring to FIG. 3, a rack configuration 90 for the heat exchanger and other components of the refrigeration system 10 is shown according to an exemplary embodiment. Rack configuration 90 includes a frame 92 supporting the multi-function heat exchanger 20 at a location above the compressor 14, and further supporting the externally disposed expansion device 50 and control module 52. According to one embodiment, heat exchanger is a shell and tube type heat exchanger having a substantially flat and horizontal internal partition 18 separating the shell 16 into a top portion 22 and a bottom portion 24, and is provided with suitable connection points (e.g. fittings, pipe-stubs, etc.), so that the rack configuration 90 can be packaged and commercially sold as a single, modular unit. The number and sizing of the tubes in each of the top and bottom portions may be any suitable size and number desired to attain the intended heat transfer performance in each of the condenser, subcooler and evaporator portions. According to the illustrated embodiment, the refrigeration system 10 with multi-function heat exchanger 20 can be operated without a receiver and without a float control device. As shown according to the embodiment of FIG. 3, the heat exchanger is shown located at a position vertically above the compressor(s). However, according to other embodiments, the heat exchanger may be located any of a variety of other positions, such as but not limited to, vertically beneath (or at least partially beneath) the compressor(s), adjacent to the compressor on either side, etc. All such configurations are intended to be within the scope of this disclosure.

According to any exemplary embodiment, a refrigeration system includes a multi-function shell and tube heat exchanger where a condenser, evaporator (e.g. chiller) and subcooler are combined in a single unit. The top condenser portion receives a liquid cooled from an air-cooled device and returns the liquid to the air-cooled device. The liquid condenses the hot refrigerant gas discharged from the compressor. The condensed refrigerant leaves the condenser and is directed into the bottom portion to be subcooled. The subcooled liquid refrigerant is expanded in an externally disposed expansion device and then directed back into the bottom portion where it chills a secondary loop of coolant that is circulated to loads throughout a store or other facility.

It is important to note that the construction and arrangement of the elements and embodiments of the refrigeration system with multi-function shell and tube heat exchanger provided herein are illustrative only. Although only a few exemplary embodiments of the present invention have been described in detail in this disclosure, those skilled in the art who review this disclosure will readily appreciate that many modifications are possible in these embodiments (such as variations in features such as components, valves, and fittings, structures, shapes, dimensions and proportions of the components of the system, use of materials, etc.) without materially departing from the novel teachings and advantages of the invention. According to other alternative embodiments, the refrigeration system with multi-function shell and tube heat exchanger may be used with any loads for transferring heat from one space to be cooled to another space or source designed to receive the rejected heat and may include commercial, institutional or residential refrigeration systems. Further, it is readily apparent that variations of the refrigeration system with multi-function shell and tube heat exchanger and its components and elements may be provided in a wide variety of types, shapes, sizes and performance characteristics, or provided in locations external or partially external to the refrigeration system. For example, components of the refrigeration system with multi-function shell and tube heat exchanger may be provided as rack-mounted system, or as a custom-installed hard-piped system, or may be provided as a modular unit or package. Accordingly, all such modifications are intended to be within the scope of the invention.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the inventions as expressed in the appended claims.

What is claimed is:

1. A refrigeration system with a multi-function heat exchanger for providing cooling to one or more loads within a facility, comprising:

a heat exchanger shell having an internal partition separating the shell into a top portion defining a condenser, and a bottom portion defining a subcooler and an evaporator;

a discharge gas inlet, a condensate outlet, a condensing fluid inlet and a condensing fluid outlet disposed on the top portion;

a liquid subcooler inlet, a subcooled liquid outlet, an evaporator gas inlet, a suction evaporator outlet, a secondary coolant inlet, and a secondary coolant outlet disposed on the bottom portion;

an expansion device disposed external of the shell and in fluid communication with the subcooled liquid outlet and the evaporator gas inlet;

a primary refrigeration loop having a compressor and configured to circulate a refrigerant from the compressor through a refrigerant flow path including the discharge gas inlet, the condenser, the condensate outlet, the liquid subcooler inlet, the subcooler, the subcooled liquid outlet, the expansion device, the evaporator gas inlet, the evaporator, the suction evaporator outlet, and back to the compressor;

a secondary coolant loop configured to circulate a coolant from the loads through a secondary cooling flow path including the secondary coolant inlet, the secondary coolant outlet, and back to the loads, wherein the coolant first subcools the refrigerant and the coolant is then cooled by the refrigerant as the coolant travels along the secondary coolant flow path between the secondary coolant inlet and the secondary coolant outlet;

a control system including a control module configured to receive a first signal representative of refrigerant temperature proximate the suction evaporator outlet and a second signal representative of refrigerant pressure proximate the suction evaporator outlet, and to provide a control signal to the expansion device to maintain a superheat temperature of the refrigerant proximate the suction evaporator outlet within a predetermined range; and a condenser cooling loop having an outdoor heat exchanger and configured to circulate a condensing fluid from the outdoor heat exchanger through a condensing flow path including the condensing fluid inlet, the condenser, the condensing fluid outlet, and back to the outdoor heat exchanger.

2. The system of claim 1 wherein the condenser, and the subcooler, and the evaporator comprise a plurality of tubes for transferring heat to or from the refrigerant.

3. The system of claim 1 wherein the heat exchanger shell and the compressor are mounted on a rack with the heat exchanger shell disposed at least partially above the compressor.

4. The system of claim 3 wherein the expansion device comprises one of a thermostatic expansion valve, a superheat valve, and a throttle valve.

5. The system of claim 4 wherein the rack, and the heat exchanger shell and the compressor, and the expansion device comprise a self-contained, modular unit.

6. The system of claim 1 wherein the loads comprise refrigerated display cases and the facility comprises a supermarket.

7. The system of claim 1 wherein the primary refrigeration loop and refrigerant flow path exclude a receiver.

8. The system of claim 1 wherein the coolant in the secondary coolant loop comprises CO2.

9. A refrigeration system with a multi-function heat exchanger for providing cooling to one or more loads within a facility, comprising:

a first heat exchanger having at least one internal partition defining a first portion having a condenser, and a second portion having a subcooler and an evaporator;

a discharge gas inlet, a condensate outlet, a condensing fluid inlet and a condensing fluid outlet disposed on the first portion of the heat exchanger;

a liquid subcooler inlet, a subcooled liquid outlet, an evaporator gas inlet, a suction evaporator outlet, a secondary coolant inlet, and a secondary coolant outlet disposed on the second portion of the heat exchanger;

an expansion device disposed external of the heat exchanger and in fluid communication with the subcooled liquid outlet and the evaporator gas inlet;

a compressor and configured to circulate a refrigerant through a refrigerant flow path including the discharge gas inlet, the condenser, the condensate outlet, the liquid subcooler inlet, the subcooler, the subcooled liquid outlet, the expansion device, the evaporator gas inlet, the evaporator, and the suction evaporator outlet;

a secondary coolant configured to circulate through a secondary cooling flow path including the secondary coolant inlet, the secondary coolant outlet, and the loads, wherein the secondary coolant first subcools the refrigerant and the secondary coolant is then cooled by the refrigerant as the secondary coolant travels along the secondary coolant flow path between the secondary coolant inlet and the secondary coolant outlet;

a control system configured to receive a signal representative of refrigerant temperature and a signal representative of refrigerant pressure, and to provide a control signal to the expansion device to maintain a temperature of the refrigerant within a predetermined range; and a second heat exchanger configured to cool a condensing fluid circulating through a condensing flow path including the condensing fluid inlet, the condenser, the condensing fluid outlet, and the second heat exchanger.

10. The system of claim 9 wherein the condenser, and the subcooler, and the evaporator comprise a plurality of tubes for transferring heat to or from the refrigerant.

11. The system of claim 9 wherein the first heat exchanger and the compressor are mounted on a rack with the first heat exchanger disposed at least partially above the compressor.

12. The system of claim 11 wherein the expansion device comprises one of a thermostatic expansion valve, a superheat valve, and a throttle valve.

13. The system of claim 12 wherein the rack, and the first heat exchanger and the compressor, and the expansion device comprise a self-contained, modular unit.

14. The system of claim 9 wherein the loads comprise refrigerated display cases and the facility comprises a supermarket.

15. The system of claim 9 wherein the secondary coolant comprises CO2.

16. The system of Claim 9 wherein the refrigerant flow path excludes a receiver.

17. The system of claim 9 wherein the second heat exchanger comprises a fan-coil unit disposed outside the facility.

* * * * *